US006623001B2

(12) United States Patent
Steinkogler et al.

(10) Patent No.: US 6,623,001 B2
(45) Date of Patent: Sep. 23, 2003

(54) SHEET STACKING APPARATUS AND METHOD FOR CONTROLLING THE FEED OF SHEET MATERIAL INTO A STACKING WHEEL

(75) Inventors: Alexander Steinkogler, Munich (DE); Thomas Hildebrandt, Kirchheim (DE); Michael Stapfer, München (DE)

(73) Assignee: Giesecke & Devrient GmbH, Munich (DE)

( * ) Notice: Subject to any disclaimer, the term of this patent is extended or adjusted under 35 U.S.C. 154(b) by 17 days.

(21) Appl. No.: 09/884,030

(22) Filed: Jun. 20, 2001

(65) Prior Publication Data

US 2002/0020963 A1 Feb. 21, 2002

(30) Foreign Application Priority Data

Jun. 20, 2000 (DE) ..... 100 30 226

(51) Int. Cl.[7] ..... B65H 43/00

(52) U.S. Cl. ..... 271/176; 271/178; 271/202; 271/315; 271/265.04

(58) Field of Search ..... 271/176, 178, 271/202, 315, 187, 263, 265.04

(56) References Cited

U.S. PATENT DOCUMENTS 4,088,314 A 5/1978 Phillips ..... 271/176
4,361,318 A * 11/1982 Stobb ..... 271/202
5,641,156 A 6/1997 Nukada et al. ..... 271/176

FOREIGN PATENT DOCUMENTS

| | | |
|---|---|---|
| DE | 27 56 223 | 12/1982 |
| EP | 0 082 195 | 1/1986 |
| GB | 2 168 687 | 6/1986 |
| JP | 61130160 | 6/1986 |
| JP | 62021663 | 1/1987 |

* cited by examiner

*Primary Examiner*—John M. Jillions
(74) *Attorney, Agent, or Firm*—Bacon & Thomas, PLLC

(57) ABSTRACT

In a sheet stacking apparatus, in particular spiral slot stacker, one determines the relative position of a group of sheets 7A, 7B, for example distance $t_a$ between the sheets or total length $t_L$ of overlapping sheets. Sheet sensor 16 is mounted for this purpose at a large distance before input point 15 so that irregularities such as distance and/or overlap within the group of sheets 7A, 7B are taken into account and corresponding steps can be taken before leading sheet 7A is fed into stacker slot 2 of stacking wheel 1. Depending on the kind of irregularity ascertained, stacking wheel 1 is stopped, slowed down or accelerated to permit collision-free feed of the group of sheets into common slot 2 or into separate slots 2. In special embodiments one influences the sheet speed by means of separately controllable transport path segments 12*a*, 12*b*, and/or input point 15 by means of control finger 8.

21 Claims, 2 Drawing Sheets

SHEET STACKING APPARATUS AND METHOD FOR CONTROLLING THE FEED OF SHEET MATERIAL INTO A STACKING WHEEL

BACKGROUND OF THE INVENTION

This invention relates to a sheet stacking apparatus, in particular a spiral slot stacker, and to a method for controlling the feed of sheet material into slots of a continuously or intermittently rotating stacking wheel.

Spiral slot stackers are used for example in sheet testing and sorting apparatuses in which stack of sheets, for example bundles of bank notes, are first singled, subsequently guided through a sensor system for testing purposes and finally stacked in different stacks by means of spiral slot stackers. The function of the spiral slot stackers is to slow down the arriving single sheets by deflecting them into a spiral-shaped path before their final stacking. In most cases of application it is uncritical if not every slot of the stacking wheel receives a sheet or a slot receives more than one sheet by way of exception during stacking.

However, one must make sure the sheets do not collide with a partition separating the slots at the moment of its delivery to the stacking wheel. The leading edge of a sheet should therefore be supplied to the stacking wheel at an ideal input point between two partitions in order to ensure collision-free and complete feed of the sheet into a slot. Since the sheets are not always fed into the stacking wheel at a synchronous time interval due to slip in the transport system or due to different sheet formats, the problem of exact feed control poses itself regardless of whether the stacking wheel rotates intermittently or continuously. In both cases it is necessary to synchronize an asynchronous sheet feed and the rotating stacking wheel in such a way that each sheet is delivered into a slot of the stacking wheel completely and without collision.

In DE 27 56 223 C2 it is proposed that one determine quantitatively the deviation of the individual sheet from its ideal position by means of a sensor at a given constant rotating speed of the stacking wheel and urge the leading sheet edge so far down by an amount proportional to the determined deviation by means of a finger at the moment of sheet delivery that the leading sheet edge is fed into the slot at the ideal sheet input point. Quantitative measurement of the position deviation is done at a distance before the delivery point so that sufficient time is available for influencing the leading sheet edge by individually deflecting the finger.

In GB 2 168 687 A and EP 0 082 195 B1 it is proposed that one influence not the leading sheet edge but the positioning of the stacking wheel by first detecting the leading edge of an approaching sheet at a certain distance before the delivery point and thereupon influencing the step speed of the stacking wheel briefly in dependence on the transport speed of the sheet such that the leading sheet edge is fed into a slot of the stacking wheel at the ideal input point.

One disadvantage of the latter proposed solution is that with sheets in close succession very high accelerations of the stacking wheel are necessary in order to bring the next slot into the ideal feed position in time. Another disadvantage results in connection with overlapping sheets, occurring in particular in the processing of used bank notes due to their poor condition. In such cases there is a high probability that the trailing sheet will be incompletely grasped and thrown out of the stacking wheel.

SUMMARY OF THE INVENTION

The problem of the present invention is therefore to provide a sheet stacking apparatus and a method for controlling the feed of sheet material into slots of a stacking wheel, the stacking wheel being influenced so as to permit defined stacking even with very short sheet distances or overlapping sheets.

This problem is solved according to the invention by a method and sheet stacking apparatus with the features of the independent patent claims. Advantageous embodiments of the invention are stated in claims dependent thereon.

While in the prior art the approach of a leading sheet edge was determined and evaluated in order to use the determined data to take steps suitable for ensuring collision-free feed of the sheet into a slot, the invention provides for a group or groups of at least two sheets also to be detected by sensor technology and evaluated and for the evaluation result for this group or groups of sheets to be used to take steps suitable for ensuring reliable delivery of all sheets of said group into the slots of the stacking wheel. Since the evaluation takes account of not only the next approaching sheet but at least the next two approaching sheets, it is possible to control the feed of sheets into the stacking wheel prospectively for the total group of sheets. In particular, the kinematics of the stacking wheel can be influenced prospectively, said influence relating to the position and/or speed and/or acceleration of the stacking wheel.

For this purpose a sheet sensor is provided which determines one or more pieces of information about the approaching sheet material, for example, the distance between two sheets, the length of a sheet or the total length of a plurality of overlapping sheets, the total thickness of a plurality of overlapping sheets, or other information permitting conclusions on the relative position of two or more sheets.

The sheet sensor is expediently disposed at a sufficient distance before the stacking wheel so that the information about the following sheet relative to the preceding sheet can be evaluated and the stacking wheel accordingly influenced before the leading sheet begins to be fed into a slot of the stacking wheel. The distance between the stacking wheel and the sheet sensor should therefore correspond to a length composed of the maximum length of the sheets to be processed, the normal distance between the sheets and an additional path, the additional path being dimensioned in dependence on the transport speed such that sufficient time is available for evaluating the sheet sensor information and suitably influencing the individual sheet flow.

A preferred embodiment of the invention provides for combining the distance measurement between two sheets and the total length measurement of the sheets or overlapping sheets. This can be done in a simple manner with a single sheet sensor, which can be formed for example as a light barrier and is preferably located at the above-described distance from the stacking wheel. By means of the light barrier one can easily ascertain the presence of sheet material in the transport path. The time period passing between two consecutive sheets serves as a measure of the distance between the sheets, and the time period passing between the distance measurements as a measure of the length of a sheet or group of sheets. If the determined distance and/or length measure deviates impermissibly from a given threshold value, one selectively deviates from a given motion sequence of the stacking wheel synchronized with the sheet singling rate and influences the stacking wheel in accordance with the individually determined sheet flow by accelerating, slowing down or stopping the stacking wheel or rotating it at very low speed.

Depending on the type of ascertained irregularity one might take the following steps for example. If a distance between two sheets is ascertained which is below a minimum distance, the stacking wheel can be briefly stopped or rotated at very low rotating speed so that both sheets can be fed into a common slot. Alternatively, the rotating speed of the stacking wheel can be briefly increased in order to compensate the shortened distance so that the two sheets are fed into separate slots.

If the determined distance exceeds a given maximum distance, it is recommendable to slow down the stacking wheel briefly in order to take the enlarged distance into account so that the two sheets are reliably fed into separate slots.

If the determined length of a sheet or group of overlapping sheets exceeds a given maximum length, the stacking wheel can be stopped or rotate at low speed or be slowed down at least so far that all sheets of said group are received completely in a common slot. If it is not ascertained before said group of sheets is fed into the slot that the next sheet or group of sheets follows at a sufficient distance, the stacking wheel is expediently stopped so that the next sheet or group of sheets can also be fed into the same stacker slot. Only when a sufficient distance is determined again, the stacking wheel is positioned for the next slot and one possibly changes over again from individual sheet flow control to synchronized control (synchronization of stacking wheel rotating speed with sheet singling rate).

In case a group of overlapping sheets is determined with a thickness sensor, it is recommendable to stop the stacking wheel since a statement on the total length of the overlapping sheets and consequently a statement on the duration the sheets require for being fed into the slot is not readily possible. The stacking wheel is positioned for the next slot only when a sufficient distance is ascertained between two sheets or groups of sheets again.

However, if the total length of the overlapping sheets is determined and evaluated in addition to the total thickness, one can ascertain exactly at which points the overlap begins and ends. Under these preconditions it is possible to attain a separation of the overlapping sheets by exactly timed brief acceleration of the stacking wheel in such a way that the sheets are fed into separate slots. One must make sure, however, that no excessive accelerations and speeds of the stacking wheel prevent the feed of the sheets or cause them to be thrown out.

For most of the aforementioned embodiments it is expedient to provide a speed sensor for determining the sheet transport speed in order to permit the slots of the stacking wheel to be positioned in time in dependence on the time period remaining for transport of the sheet material to the stacking wheel. In addition, the transport speed can be taken into account when influencing the kinematics of the stacking wheel in such a way that the feed of a sheet or group of sheets into a slot is completed just before the next sheet or group of sheets is fed into the next slot.

Advantageously, the stacking wheel rotates at simple or multiple synchronous speed, synchronous speed $v_S$ resulting from nominal singling rate $r_N$ (sheets per minute) and number $n_F$ of slots per revolution. A multiple synchronous speed means that in nominal operation of the machine, i.e. at synchronized singling rate and stacking wheel speed, not every slot of the stacking wheel receives a sheet. This reduces the risk of consecutive sheets hindering each other during stacking when they hit each other with bends or folds. When a group of sheets is fed at small distances, each slot can then selectively receive a sheet in order to reduce the duration of positioning of the stacking wheel for the next desired slot.

A special embodiment of the invention provides that in addition to or instead of influencing the kinematics of the stacking wheel one influences the sheet speed in at least part of the sheet transport path in order to put irregularly spaced sheets or overlapping sheets at a standardized distance so that the feed of one sheet per slot is more frequently possible. For this purpose a transport system is provided which has at least one transport path segment whose transport speed can be influenced in dependence on the sheet sensor information.

According to another special embodiment of the invention one can influence, in addition to or instead of the kinematics of the stacking wheel, the sheets by means of one or more control fingers, as described fundamentally in DE 27 56 223 C2 mentioned at the outset, the disclosure of which is incorporated herein by reference.

DESCRIPTION OF THE DRAWINGS

In the following the invention will be described by way of example with reference to the accompanying drawings, in which.

DETAILED DESCRIPTION OF THE INVENTION

Figure 1:
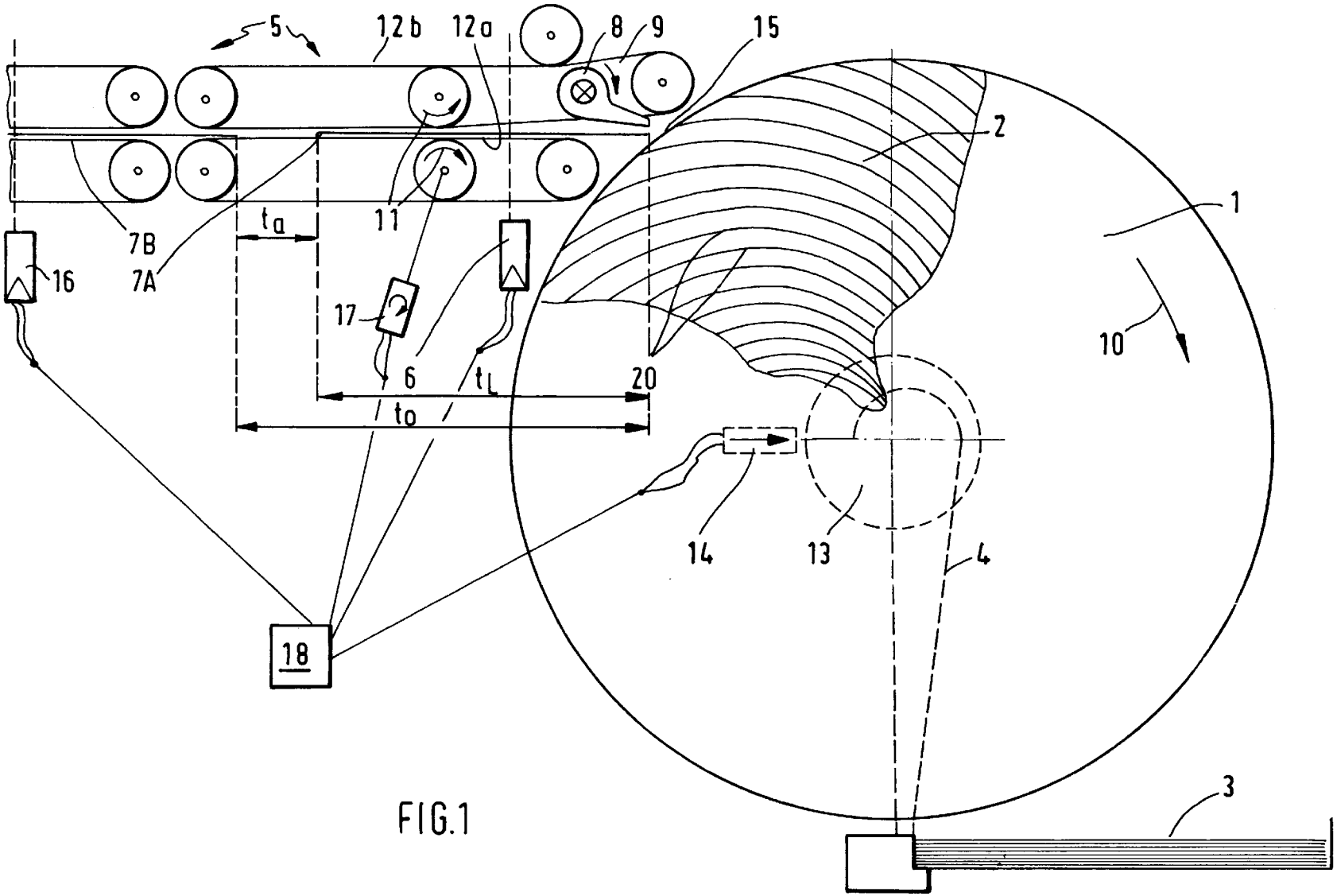
FIG. 1 shows a spiral slot stacker according to the present invention.

The general view of a spiral slot stacker shown schematically in FIG. 1 shows stacking wheel 1 with a number of slots 2 formed by partitions 20 and circumferentially distributed in a spiral shape. Stacking wheel 1 rotates in the direction of arrow 10, receiving in slots 2 sheets 7A, 7B which are supplied by transport system 5 driven in the direction of arrows 11, and transporting the sheets in the circumferential direction of stacking wheel 1 until they are finally pulled out of slots 2 by stripper 4 and drop onto stack 3. The spirally curved partitions perform the function of continuously slowing down arriving sheets 7A, 7B.

In the case of continuously driven stacking wheel 1 it is important that sheet 7A is fed into slot 2 at optimal input point 15 so that sheet 7A has been fed completely into slot 2 before lower partition 20 of slot 2 passes input point 15.

In normal operation the rotation of stacking wheel 1 is synchronized with the singling rate, regardless of whether stacking wheel 1 rotates intermittently or continuously, and rotates at synchronous speed $v_S$ which results from nominal singling rate $r_N$, i.e. the number of sheets singled per minute, and number $n_F$ of slots 2 uniformly distributed along the circumference of stacking wheel 1 as:

$$v_S = r_N / n_F.$$

The stacking wheel preferably rotates at a speed corresponding to the multiple of the synchronous speed.

At a relatively great distance from stacking wheel 1 there is sheet sensor 16. Sheet sensor 16 is designed as a light barrier and detects the presence or absence of sheet material in transport system 5. Between sheet sensor 16 and stacking wheel 1 there is proximity sensor 6 near stacking wheel 1 which is likewise formed as a light barrier and serves to detect the leading edge of approaching sheet 7A. Said proximity sensor 6 might be omitted, as to be explained below, in particular if sheet transport speed sensor 17 is provided.

With synchronized singling of like sheets without any irregularities occurring (distance variations or overlap of sheets), one obtains synchronized clock length $t_0$ of consecutive sheets 7A, 7B which is inversely proportional to singling rate $r_N$ and composed of time period $t_L$ (standard length), that is the time a sheet requires to be transported over an arbitrary point of the transport system, and time period $t_a$ (synchronized distance) passing between two consecutive sheets 7A, 7B.

Both synchronized distance $t_a$ and standard length $t_L$ are determined with sheet sensor 16.

The distance between proximity sensor 6 and sheet sensor 16 is selected to be greater than synchronized clock length $t_0$ so that at the time when leading sheet 7A reaches proximity sensor 6 the information delivered by sheet sensor 16 has already been evaluated by evaluation device 18 and it is certain whether synchronized clock length $t_0$ between two consecutive sheets 7A, 7B is within given tolerance limits or an impermissible irregularity is present, for example in the distance between the two sheets or in the total length of a sheet or group of sheets. At the moment when proximity sensor 6 ascertains the arrival of sheet 7A, information about the position of next sheet 7B is consequently already available so that the kinematics of stacking wheel 1 can be influenced matching the individual, asynchronous sheet flow. In the simplest case, stacking wheel 1 is stopped in order to permit overlapping sheets or sheets in close succession to be fed into common slot 2, and only when the distance between two consecutive sheets 7A, 7B is above a minimum distance, next slot 2 of stacking wheel 1 is brought to the feed position. Information about the exact positioning of the stacking wheel is provided by position sensor 14, which ascertains the stacking wheel position with reference to contact disk 13 and passes it on to evaluation unit 18. If position sensor 14 has only a resolution corresponding to the number of slots 2 or partitions 20, a higher resolution can be attained if information from the drive of stacking wheel 1 is evaluated in addition to position sensor 14. If the drive is formed by a stepping motor, the steps made by the stepping motor can be counted for example. Since it is known how many steps lie between two partitions 20 or slots 2, the exact position can consequently be determined.

Figure 2:
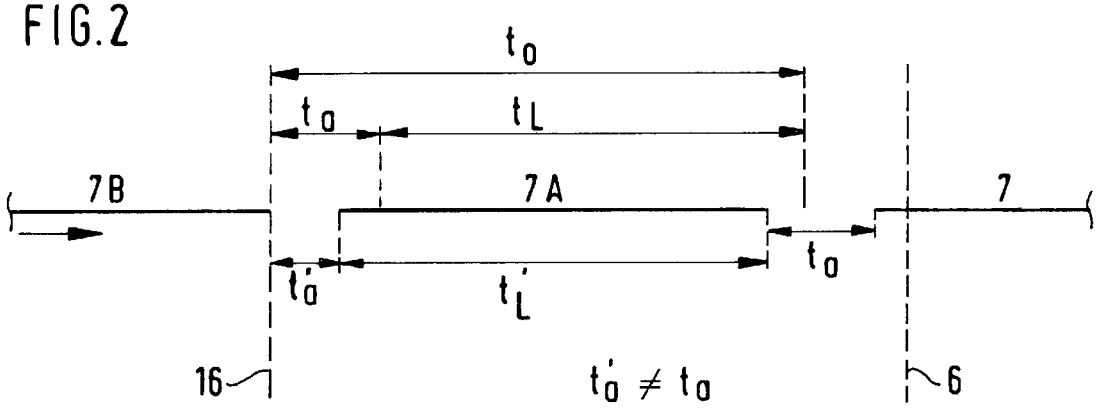
FIG. 2 shows the principle of distance measurement.
Figure 3:
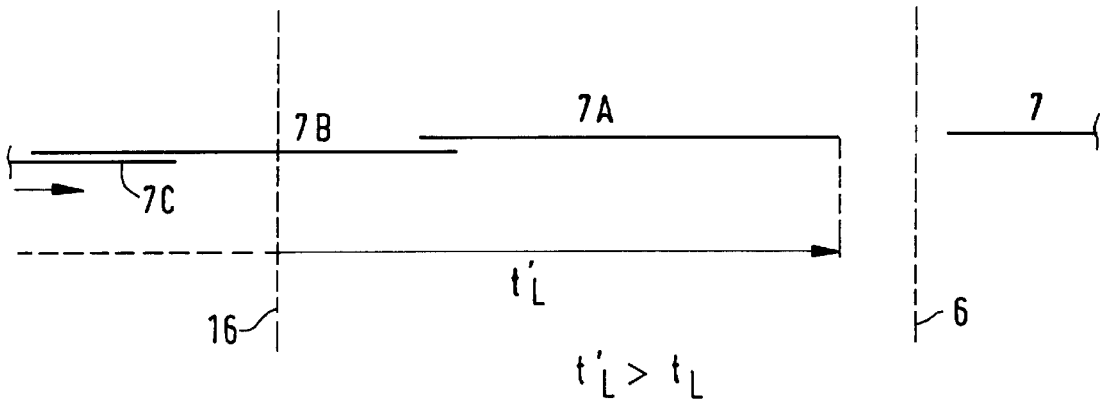
FIG. 3 shows the principle of total length measurement.
Figure 4:
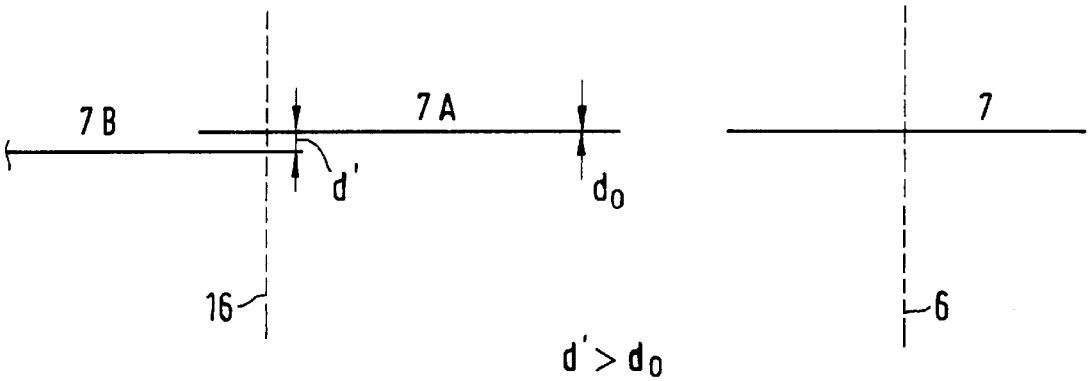
FIG. 4 shows the principle of total thickness measurement.

With reference to FIGS. 2 to 4 the detection of various irregularities and the corresponding steps to be taken will now be described in more detail. Each figure shows schematically a section of the transport path of sheet material 7 in the direction of the arrow, sheets 7A, 7B and 7A, 7B, 7C each defining a group of sheets whose position relative to each other is determined by means of sheet sensor 16 and evaluated in order to use the evaluation result to exert a suitable influence on the kinematics, i.e. the position, speed or acceleration, of stacking wheel 1. $t_0$ designates the synchronized clock length, i.e. the distance between two consecutive sheets in synchronized operation without any irregularities occurring, which is composed of synchronized distance $t_a$ and length $t_L$ of the sheet material to be processed, as described above.

FIG. 2 shows the case of an irregularity of the distance between sheets 7A, 7B. Actual distance $t'_a$ between sheets 7A, 7B of this group of sheets is smaller than synchronized distance $t_a$. If no steps are taken, this can mean that trailing sheet 7B is fed with its leading edge into slot 2 in which leading sheet 7A was already received so that trailing sheet 7B collides with partition 20. Since proximity sensor 6 determines the arrival of leading sheet 7A at a time when the irregularity of the sheet distance is already recognized and evaluated, a suitable step can be taken to prevent this collision.

For example, singling wheel 1 can be stopped so that all arriving sheets 7A, 7B, . . . can be received in common slot 2 until sheet sensor 16 reports sufficient distance $t'_a > t_a$ from following sheet 7C or a following group of sheets which permits further clocking of the stacking wheel. On the other hand, if information about the sheet transport speed is available through speed sensor 17 and taken into account in influencing the kinematics of stacking wheel 1, it is also possible to influence the rotating speed of stacking wheel 1 selectively in such a way that trailing sheet 7B is fed into next desired slot 2. For this purpose, stacking wheel 1 must merely be briefly accelerated or pre-positioned by a corresponding amount. Conversely, if distance $t'_a$ between sheets 7A and 7B of the group of sheets 7A, 7B is greater than synchronized distance $t_a$, stacking wheel 1 must merely be slowed down by a corresponding amount in order to obtain a collision-free feed of trailing sheet 7B into the next desired slot.

Instead of completely stopping stacking wheel 1, one can also move it on slowly so that stacking wheel 1 moves on only by a fraction of slot 2 in each case for the duration of the feed of sheets 7A, 7B.

FIG. 3 shows the case that sheet sensor 16 determines total length $t_L$ of the sheet or group of sheets 7A, 7B, 7C which is above standard length $t_L$. At the time when the approach of leading sheet 7A is reported by proximity sensor 6, it is consequently already certain that a step must be taken to ensure the feed of a group of overlapping sheets 7A, 7B, . . .

This step can again consist of stopping stacking wheel 1 or moving it on at low speed until all sheets of this group of sheets are received in same slot 2, i.e. until sheet sensor 16 reports distance $t'_a$ between two consecutive sheets which is greater than or equal to synchronized distance $t_a$. In other words, if sheets 7A, 7B, 7C are followed by another sheet whose distance $t'_a$ is comparatively low, steps for influencing the stacking wheel are taken as described in connection with FIG. 2.

FIG. 4 shows a case in which sheet sensor 16 is designed (at least also) as a thickness sensor. That is, sheet sensor 16 ascertains on the basis of actually determined thickness d' of the sheet material whether an impermissible deviation from given sheet thickness $d_0$ is present and infers in the affirmative case a group of overlapping sheets 7A, 7B. A step to be taken here may be the same steps as explained in connection with FIG. 3, where overlapping sheets were likewise determined (although by determining total length $t'_L$).

Sheet sensor 16 formed as a thickness sensor can likewise be formed as a light barrier, but the intensity of the light shining through the sheet material is measured here. This permits determination by a single sensor of the exact positions of both the leading edge of leading sheet 7A (simple light barrier) and the leading edge of following sheet 7B and trailing edge of leading sheet 7A (intensity measurement). It is thus possible to accelerate stacking wheel 1 with consideration of the sheet transport speed such that sheets 7A and 7B are fed into separate slots 2. That is, this special embodiment also involves information about the sheet transport speed, it being determined for example by means of speed sensor 17 by ascertainment of the rotating speed of a transport running wheel.

Proximity sensor 6 may also be omitted since it merely provides the information that sheet material 7 is approaching stacking wheel 1 to permit the necessary steps to be taken to influence the kinematics of stacking wheel 1 in time before the sheet material is fed into slot 2. However, if the sheet transport speed is known, for example through speed sensor 17, sheet sensor 16 suffices for determining the time when the sheet material will hit stacking wheel 1. For this time results in simple fashion from the ratio of the sheet sensor distance to the determined transport speed.

Consideration of the transport speed in determining the steps to influence the kinematics of the stacking wheel can advantageously also be utilized to adapt the motion sequence of the stacking wheel to the time available until the feed of the next sheet in such a way that the stacking wheel positioning process is just completed by the time the next sheet arrives.

The spiral slot stacker according to FIG. 1 provides as a further additional or separate step that transport system 5 has transport path segment 12A, 12B whose transport speed can be influenced. Depending on which arrangement of sheets 7A, 7B of a group of sheets 7A, 7B is determined by sheet sensor 16, the speed of transport path segment 12A, 12B is controlled. Gaps within groups of sheets can be varied to reach the synchronized distance and overlapping sheets can be drawn apart. This permits more frequent stacking of one sheet per slot.

As a further additional or separate step, FIG. 1 shows control finger 8 which acts on the transported sheet material perpendicularly from above in the direction of arrow 9, therefore making it possible to urge the sheet material downward relative to the transport direction. For example in the case of sheets in rapid succession, it will deflect trailing sheet 7B toward next desired slot 2 even when said slot has not yet reached the actual feed position at this time.

The two latter steps, i.e. individual control of the sheet transport speed in a transport path segment and/or deflection of the sheet material at the delivery point to stacking wheel 1 by means of one or more control fingers 8, also make it possible to control the sheet feed into slots 2 of stacking wheel 1 without necessarily having to influence the kinematics of the stacking wheel. It is of advantage in both cases, however, to take the particular step on the basis of information derived from a group of sheets 7A, 7B, . . . so as to permit prospective influencing of the system.

Obviously, one must deviate from the described control of the feed of sheet material into a stacking device by evaluation of a group of at least two sheets whenever at least two sheets are not available for evaluation, as is the case for example for the feed of the first sheet.

The invention not only makes it possible to change over from synchronized operation to individual sheet flow control when irregularities occur, but is also in particular suitable for working constantly in the individual sheet flow control mode, when for example sheet material of a great variety of formats must be stacked.

It is likewise possible to transport and/or stack the sheet material both along its long side and along its short side in the transport system and/or spiral slot stacker.

Furthermore it is possible for the stacker to be constructed according to a concept deviating from the described spiral slot stacker but wherein the sheet material must nevertheless be delivered to the stacker at defined times in order to ensure reliable and proper stacking in the stacker. Such a stacker may have for example a rotating drum with openings spaced on its surface which are subjected to negative pressure. Other periodically, continuously or intermittently operated stacking devices, which can be formed for example as joggers, are likewise possible if, as with rotating stackers, statements can be made about the times when the sheet material is received by the stacking devices in order to permit the described control.

What is claimed is:

1. A method for controlling the feed of sheet material traveling along a transport path into slots of a continuously or intermittently rotating stacker wheel, comprising the steps of:

detecting with a sensor system the presence of at least two sheets of sheet material overlapping at a predetermined distance along the transport path before the stacker wheel, the sensor system configured to determine a length or thickness of the overlapping sheet material;

evaluating the detected presence of overlapping sheet material; and rotating the stacker wheel in accordance with the evaluation result.

2. The method according to claim 1, further comprising changing over from a synchronized feed control wherein the sheet material flow speed is in a defined relationship to the rotational speed of the stacker wheel, to an individual sheet flow control wherein the rotation of the stacker wheel is controlled individually when the evaluation result indicates an irregularity in sheet material flow.

3. The method according to claim 1, wherein the predetermined distance is greater than the length or width of the largest sheet material fed into the stacker wheel.

4. The method according to claim 1, wherein the sensor system determines the distance between two consecutive sheets along the transport path.

5. The method according to claim 4, further comprising the step of reducing or stopping the rotational speed of the stacker wheel when a distance between two consecutive sheets is smaller than a predetermined distance such that the two sheet material are received by a single slot of the stacker wheel.

6. The method according to claim 4, further comprising the step of increasing the rotational speed of the stacker wheel when a distance between two consecutive sheets is smaller than a predetermined distance such that the two sheets are received by separate slots of the stacker wheel.

7. The method according to claim 1, further comprising the step of reducing or stopping the rotational speed of the stacker wheel when the determined length of overlapping sheet material is greater than a predetermined length such that all or individual sheets of the detected overlapping sheet material are received by a single slot of the stacker wheel.

8. The method according to claim 1, further comprising the step of increasing the rotational speed of the stacker wheel when the determined length of overlapping sheet material is greater than a predetermined length such that all or individual sheets of the detected overlapping sheet material are received by separate slots of the stacker wheel.

9. The method according to claim 1, further comprising the step of reducing the rotational speed of or stopping the stacker wheel when the determined thickness of overlapping sheet material is greater than a predetermined thickness such that the detected overlapping sheet material is received by a single slot of the stacker wheel.

10. The method according to claim 1, further comprising the step of adjusting the rotational speed of the stacker wheel as a function of the transport speed of detected sheet material such that the feeding of a single sheet or overlapping sheet material into a slot is completed just before the next sheet or overlapping sheet material is fed into a following slot.

11. The method according to claim 2, wherein the synchronized feed control includes rotating the stacker wheel at a synchronous speed=$r_N/n_F$, where $r_N$ is the nominal singling rate in sheets per minute and $n_F$ is the number of slots per revolution of the stacker wheel.

12. The method according to claim 2, wherein the synchronized feed includes rotating the stacker wheel at an integral multiple of the synchronous speed $v_s=r_N/n_F$, where $r_N$ is the nominal singling rate in sheets per minute and $n_F$ is the number of slots per revolution of the stacker wheel.

13. The method according to claim 1, wherein the transport speed of sheet material traveling along the transport path is adjusted in at least a part of the transport path in accordance with the evaluation result.

14. The method according to claim 1, further comprising the step of deflecting the sheet material in a direction perpendicular of the transport path by at least one control finger in accordance with the evaluation result directly prior to the sheet material being received by a slot of the stacker wheel, thereby adjusting an input point at which the sheet material is fed into the slot.

15. A sheet stacking apparatus, comprising:

a transport system for transporting sheet material along a predetermined transport path;

a stacker device in communication with the transport system and arranged to receive sheet material transported along the transport path;

a sheet sensor system configured to detect the presence of at least two overlapping sheets of sheet material along the transport path at a predetermined distance before the stacker device, the sensor system configured to determine a length or thickness of at least two overlapping sheets of sheet material;

an evaluation device connected to the sheet sensor system and arranged to evaluate information communicated thereto by the sheet sensor; and a control device arranged to adjust the rotational speed of the stacking device in accordance with the evaluation result.

16. The sheet stacking apparatus according to claim 15, wherein the predetermined distance is greater than the length or width of the largest sheet to be stacked.

17. The sheet stacking apparatus according to claim 15, wherein the sensor system includes a light barrier.

18. The sheet stacking apparatus according to claim 15, further comprising a transport speed sensor.

19. The sheet stacking apparatus according to claim 15, further comprising a proximity sensor disposed between the sensor system and the stacker device.

20. The sheet stacking apparatus according to claim 15, wherein the transport system includes at least one segment along the transport path having a transport speed adjusted in accordance with the evaluation result.

21. The sheet stacking apparatus according to claim 15, wherein the transport system includes at least one control finger arranged directly before the stacker device for deflecting in a direction perpendicular to the direction of the transport path in accordance with the evaluation result.

* * * * *